US005727678A

United States Patent [19]

Chen

[11] Patent Number: 5,727,678

[45] Date of Patent: Mar. 17, 1998

[54] TWO-IN-ONE PAPER DISH AND CUP HOLDER

[76] Inventor: Chin Chen Chen, No. 7, Alley 5, Lane 3, Rhy Shin Rd., Dong Shan, Yi Lan County, Taiwan

[21] Appl. No.: 662,133

[22] Filed: Jun. 12, 1996

[51] Int. Cl.[6] ..... A47G 19/06

[52] U.S. Cl. ..... 206/217; 206/545; 220/574

[58] Field of Search ..... 206/217, 541, 206/545; 220/23.83, 23.86, 556, 574, 574.1, 575

[56] References Cited

U.S. PATENT DOCUMENTS

| | | | |
|---|---|---|---|
| 4,461,396 | 7/1984 | Harper | 220/23.83 |
| 4,607,758 | 8/1986 | Stevens | 220/23.83 |
| 4,966,297 | 10/1990 | Doty | 220/23.83 |
| 4,989,742 | 2/1991 | Powell | 220/23.83 |
| 5,085,391 | 2/1992 | Perger et al. | 220/23.83 |
| 5,114,038 | 5/1992 | Quensen | 220/575 |
| 5,234,125 | 8/1993 | Roberts | 220/574 |
| 5,390,798 | 2/1995 | Yanuzzi | 220/575 |
| 5,551,593 | 9/1996 | Wiens | 220/575 |

*Primary Examiner*—Jimmy G. Foster

*Attorney, Agent, or Firm*—Beveridge, DeGrandi, Weilacher & Young, L.L.P.

[57] ABSTRACT

Disclosed is a two-in-one paper dish and cup holder which includes a paper-made dish, a cup holder integrally formed to one side of the dish, a thermal insulating pad disposed in the cup holder adjacent to the paper dish, and an arcuate connecting portion extending between the dish and the cup holder at one side thereof. The paper dish, the cup holder and the arcuate connecting portion together define a thumb hole for a thumb to upward extend therethrough, such that a user may hold food and drink or soup at the same time with only one hand by using the two-in-one paper dish and cup holder. The thermal insulating pad may be downward bent to locate between a hot or cold cup held in the cup holder and a back of the user's hand.

1 Claim, 6 Drawing Sheets

TWO-IN-ONE PAPER DISH AND CUP HOLDER

BACKGROUND OF THE INVENTION

A conventional dish or plate 1, as shown in FIG. 1, is usually used to hold food only. However, in general at parties, food and drink or soup are provided at the same time. When a guest holds such a conventional dish or plate for food with one hand and holds a cup for drink or soup with another hand, he or she will be not able to enjoy the food or drink. On the other hand, a cup positioned in the dish or plate tends to skid or turn over. This is, of course, very inconvenient to the guest and will spoil the party. It is therefore desirable to develop an improved product which eliminates the drawbacks which exist in the conventional dish and cup used at a party.

SUMMARY OF THE INVENTION

A primary object of the present invention is to provide a two-in-one paper dish and cup holder. The product according to the present invention associates a paper dish with a cup and provides a specially formed thumb hole, so that a guest in a party may use only one hand to hold the dish and the cup at the same time.

The two-in-one paper dish and cup holder according to the present invention includes a paper-made dish, a cup holder integrally form to one side of the paper dish, a bendable thermal insulating pad disposed in the cup holder adjacent to the paper dish, and an arcuate connecting portion disposed at one side of the paper dish and the cup holder to extend therebetween, so that a thumb hole is left between the connecting portion and the dish and the cup holder. A user may hold the product by upward extending his or her thumb through the thumb hole while supports a bottom of the paper dish with his or her palm. When a cup is positioned into the cup holder, the thermal insulating pad is automatically bent down by the cup and forms a means to separate a cup with hot or cold drink or soup from the palm supporting the paper dish. Such two-in-one paper dish and cup holder is convenient and comfortable and is therefore very suitable for all kinds of parties.

DETAILED DESCRIPTION OF THE PREFERRED EMBODIMENTS

The structure and function of the present invention will now be described in more details with reference to the accompanying drawings.

Figure 1:
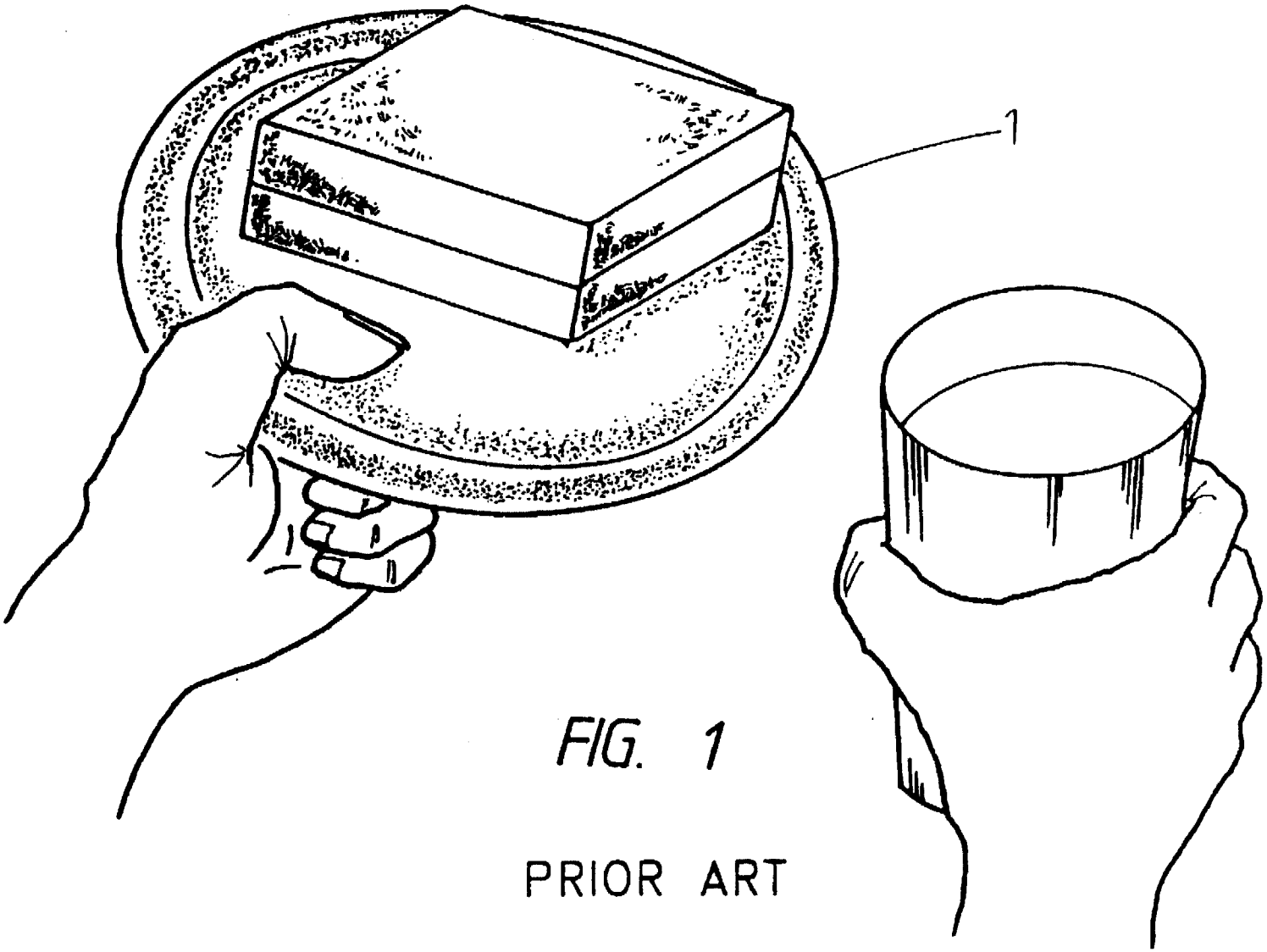
FIG. 1 PRIOR ART
FIG. 1 shows a conventional dish in use.
Figure 2:
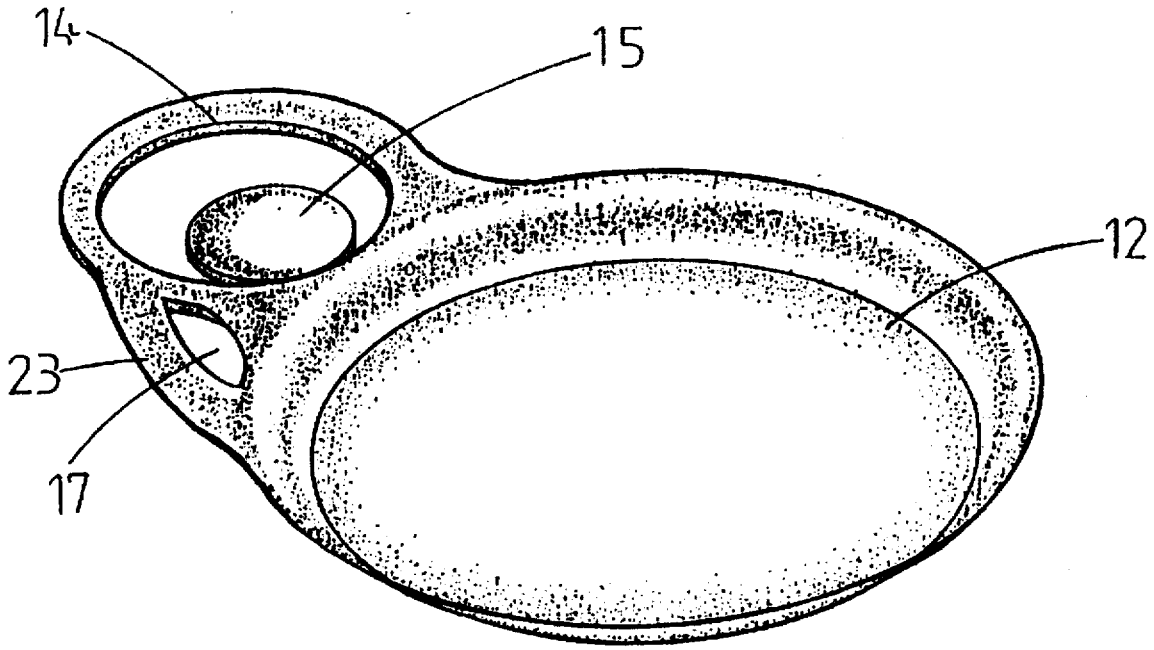
FIG. 2 is a perspective showing a two-in-one paper dish and cup holder according to the present invention.

Please refer to FIG. 2. The present invention is a two-in-one paper dish and cup holder mainly including a paper-made dish 12, a cup holder 14 integrally formed to one side of the paper dish 12, a thermal insulating pad 15 bendably connected between the paper dish 12 and the cup holder 14, an integrally formed arcuate connecting portion 23 extending from one side of the cup holder 14 to the same side of the paper dish 12, a thumb hole 17 formed between the arcuate connecting portion 23 and a joint of the paper dish 12 and the cup holder 14.

Figure 3:
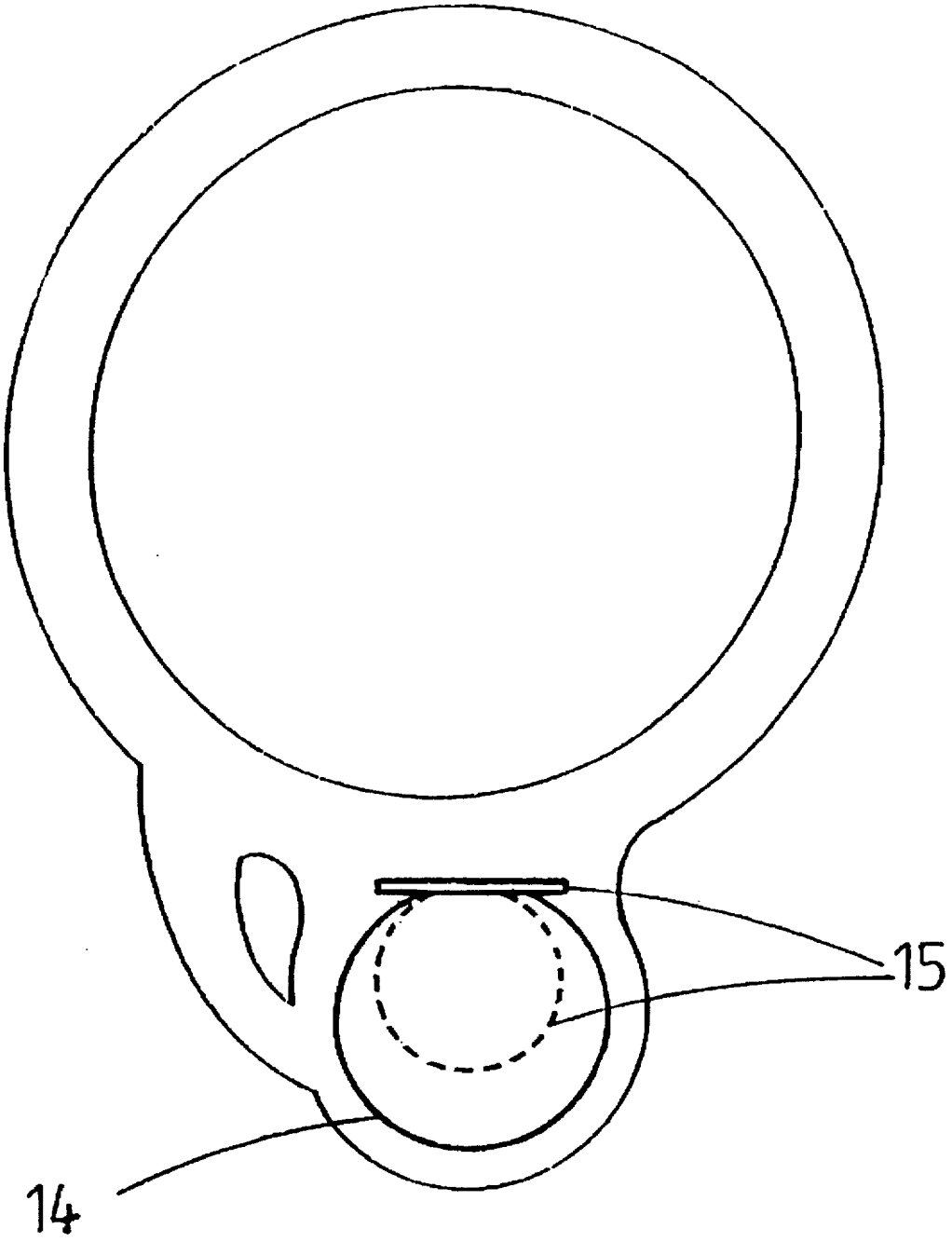
FIG. 3 is a bottom plan view showing the two positions of the thermal insulating pad of the present invention.

The thermal insulating pad 15 may change from a first flat position to a second vertical position, as shown in FIG. 3, when a cup is positioned into the cup holder 14 and bends the thermal insulating pad 15 downward relative to the paper dish 12.

Figure 4:
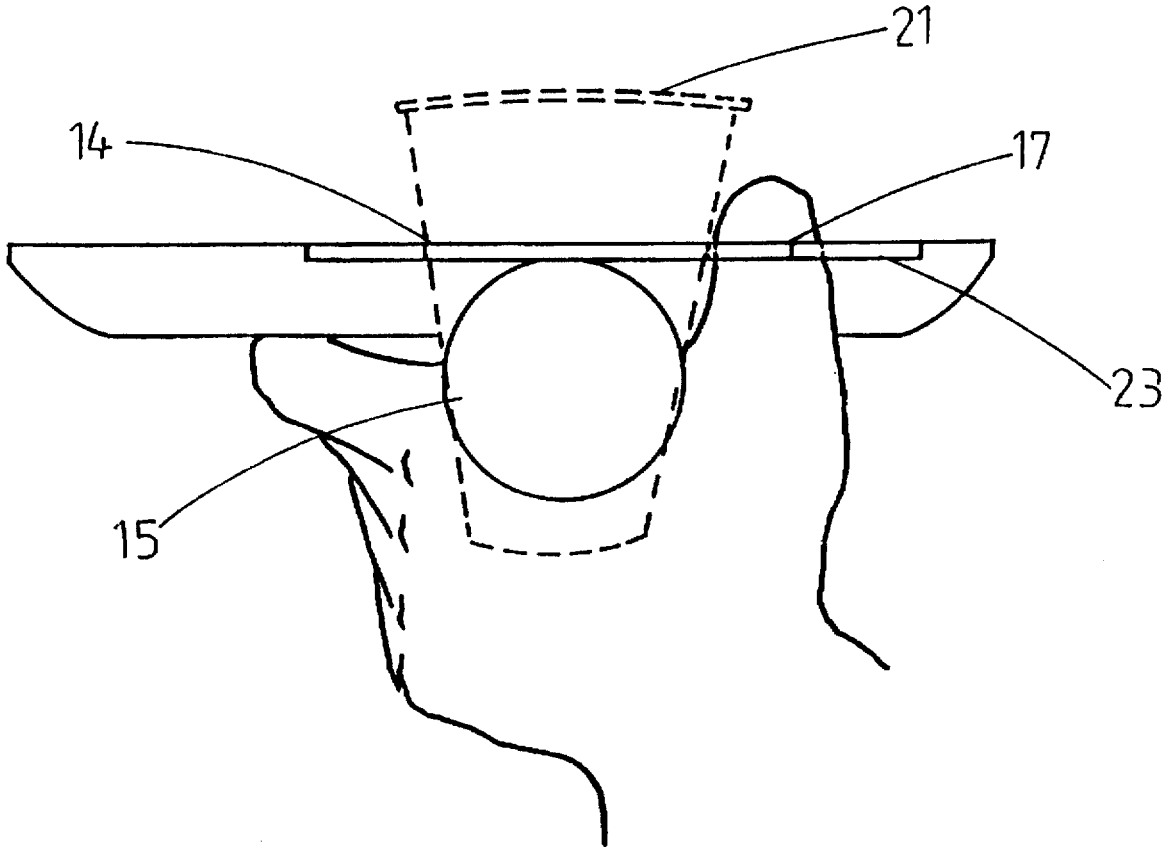
FIG. 4 is a side view showing the two-in-one paper dish and cup holder of the present invention with the thermal insulating pad in a bent and functioning position.

Please refer to FIG. 4. When a user holds the two-in-one paper dish and cup holder of the present invention by upward extending his or her thumb through the thumb hole 17 to rest the same against the arcuate connecting portion 23 and supporting a Bottom of the paper dish with the rest portion of the same hand, the paper dish 12 can be evenly and stably held. When a cup 21 with drink or soup is positioned into the cup holder 14, the thermal insulating pad 15 is bent downward by the cup 21 to form a partition just between the cup 21 and a back of the user's hand, serving as a thermal insulating means.

Figure 5:
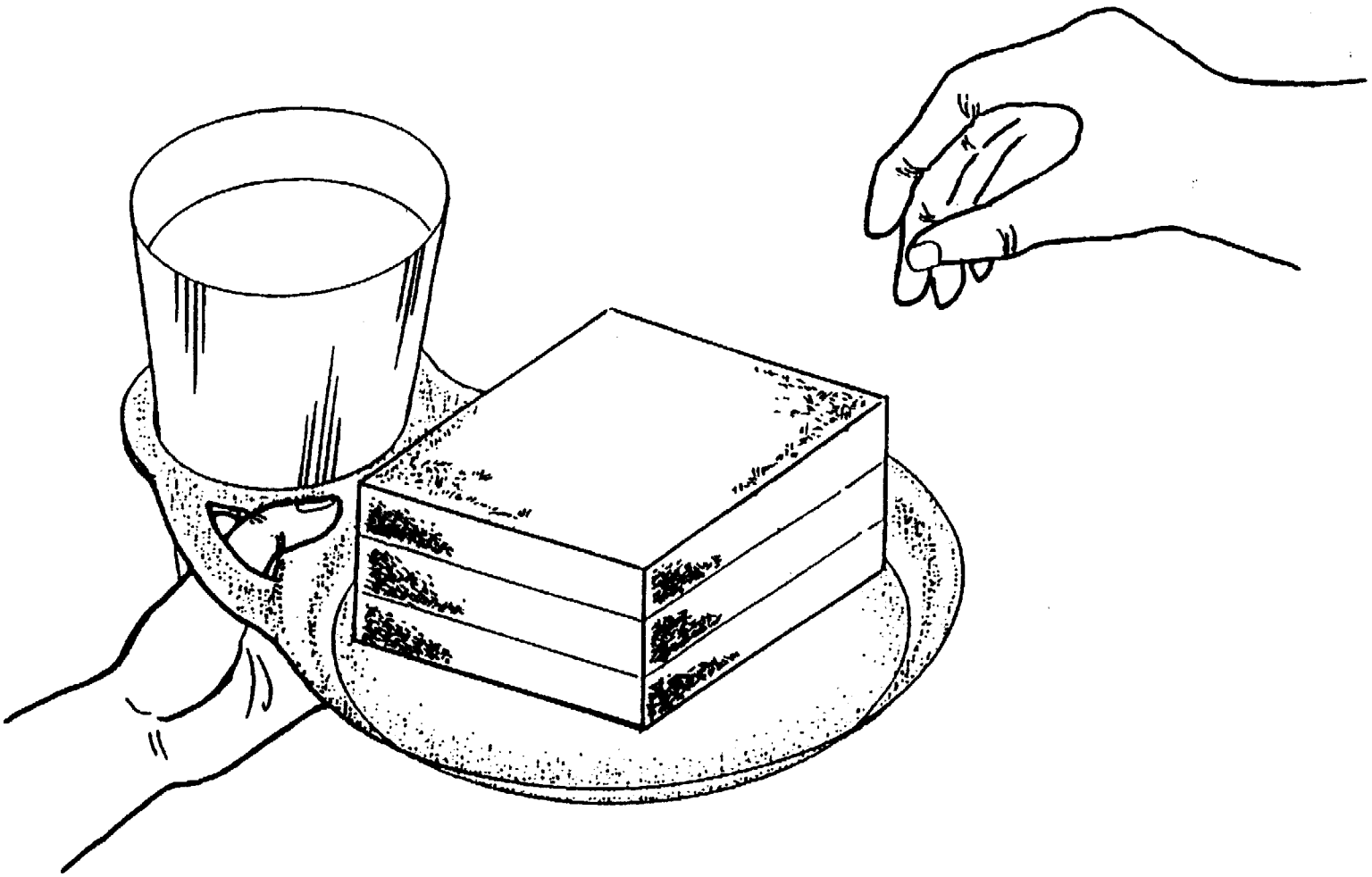
FIG. 5 is a perspective showing the two-in-one paper dish and cup holder of the present invention in use.

FIG. 5 illustrates the two-in-one paper dish and cup holder of the present invention being used to hold some snack in the dish 12 and a cup in the cup holder 14. As shown, only one hand is needed to stably hold the whole present invention by upward extending the thumb through the thumb hole 17 thereof. The snack and the drink can be positioned on the present invention at the same time. The user may use another hand to easily get the snack or the drink.

Figure 6:
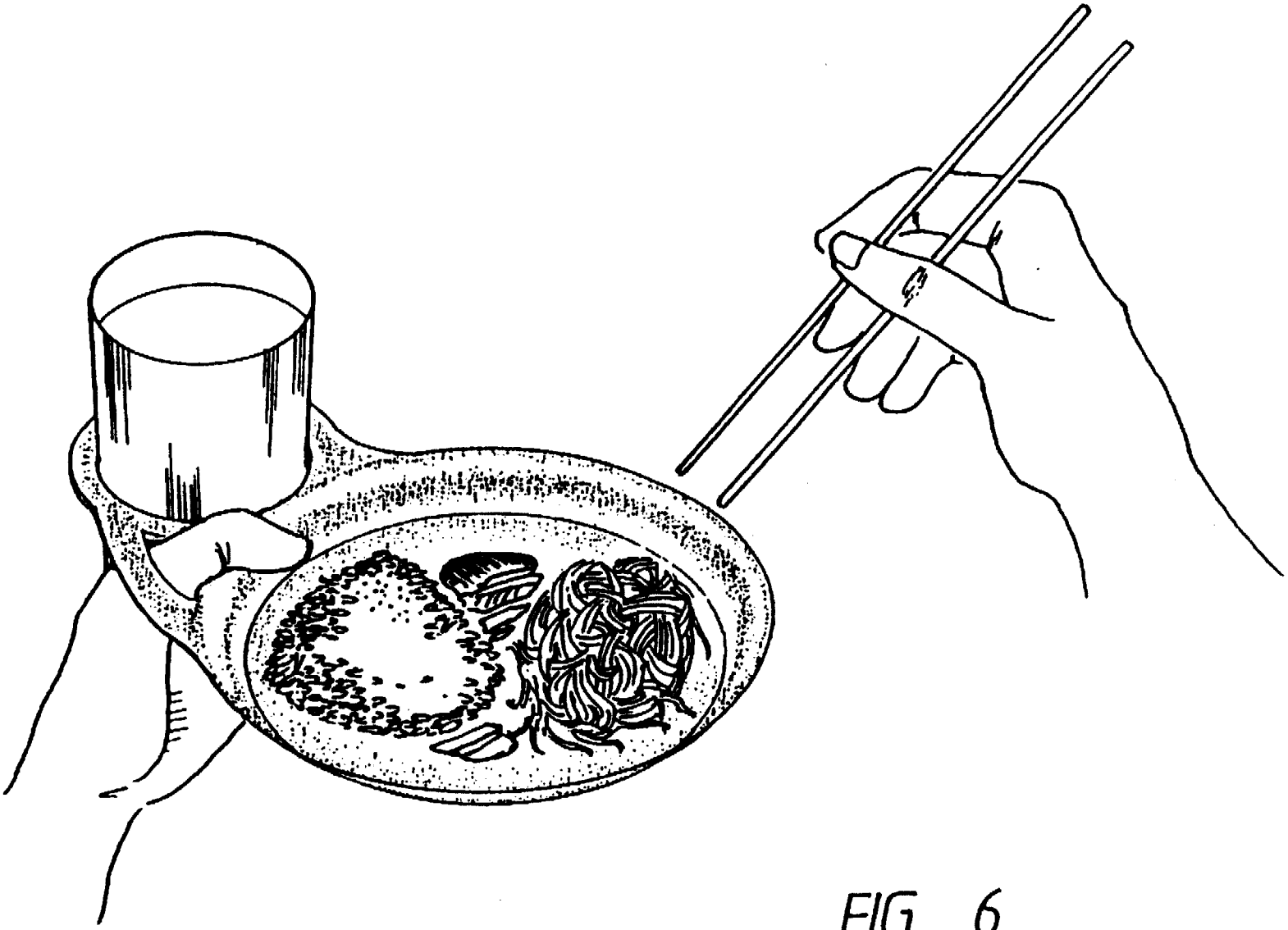
FIG. 6 is another perspective showing the present invention in use.

FIG. 6 illustrates the two-in-one paper dish and cup holder of the present invention being used to hold some Chinese food with hot soup contained in the cup 21. With the thermal insulating pad 15, the hot soup in the cup will not prevent the user from convenient use of the present invention.

What is claimed is:

1. An integrally formed two-in-one dish and cup holder, comprising:

a dish for holding food or a snack thereon, a cup holder integrally formed to one side of said dish for holding a cup therein, a thermal insulating pad disposed in said cup holder adjacent to said dish, and a thumb hole formed at one side between said cup holder and said paper dish for a thumb to extend therethrough, wherein said thermal insulating pad is downward bendably connected to said cup holder adjacent to said dish, whereby when a cup is positioned into said cup holder, said thermal insulating pad is bent downward by said cup to be located between the cup in said cup holder and a back of a hand supporting said dish.

* * * * *